US006386795B1

(12) United States Patent
Delbaere

(10) Patent No.: US 6,386,795 B1
(45) Date of Patent: May 14, 2002

(54) SYSTEM FOR STABILIZATION OF SANDY SHORES

(75) Inventor: Bernard Delbaere, De Haan (BE)

(73) Assignee: Delvac N.V. (BE)

( * ) Notice: Subject to any disclaimer, the term of this patent is extended or adjusted under 35 U.S.C. 154(b) by 0 days.

(21) Appl. No.: 09/559,371

(22) Filed: Apr. 27, 2000

(30) Foreign Application Priority Data

May 4, 1999 (EP) ..... 99870095

(51) Int. Cl.[7] ..... E02B 3/04

(52) U.S. Cl. ..... 405/15; 405/302.6

(58) Field of Search ..... 405/15, 36, 37, 405/40, 41, 302.4, 302.6

(56) References Cited

U.S. PATENT DOCUMENTS

| | | | | | |
|---|---|---|---|---|---|
| 3,565,491 | A | * | 2/1971 | Frazier | 406/12 |
| 4,087,572 | A | | 5/1978 | Nimerick | 427/214 |
| 4,645,377 | A | * | 2/1987 | Vesterby | 405/15 |
| 4,898,495 | A | * | 2/1990 | Lin | 405/15 |
| 5,022,784 | A | * | 6/1991 | DeVries et al. | 405/15 |
| 5,149,227 | A | * | 9/1992 | Parks | 405/15 |
| 5,294,213 | A | * | 3/1994 | Parks | 405/15 |

* cited by examiner

*Primary Examiner*—David Bagnell
*Assistant Examiner*—Frederick L. Lagman
(74) *Attorney, Agent, or Firm*—Ladas & Parry

(57) ABSTRACT

To battle the problem of sand loss due to wind action on a sandy shore a system is used which pumps water from the nearby water volume and makes the sand wet depending on wind speed and/or other conditions such as rain, moistness of the sand, wind direction and temperature.

12 Claims, 6 Drawing Sheets

SYSTEM FOR STABILIZATION OF SANDY SHORES

The invention relates to a system for stabilisation of sandy shores.

It has been a problem for a long time that sandy shores, such as beaches, change shape and form. In particular sand depletion in the winter season forms a problem. At the beginning of the summer season the beach is too small for the planned commercial activities and/or the beach is so small that dunes or dikes behind the beach are so close to the sea that the sea threatens to break through.

Methods for reducing the effects of sand depletion comprise amongst others supplying sand at the beginning of the summer season. The disadvantages of such supply are that it is costly, often the sand is taken from the sea and has a different coarser constitution than the sand of the shore for instance having more shells in it which leads to complaints from beach goers, and the shore cannot be used for any other activity during and for some time after the new sand has been supplied. Also the sand is taken away from the sea bed, if such is done near the shore dangerous holes are made which may pose a threat to the life of swimmers. If the sand is taken away from the sea bed at a large 'safe' distance from the shore this increases the cost of the method considerably and furthermore generally the further away from the shore the coarser the sand is, and/or the sand could have a different colour or other clearly distinguishing feature.

Other methods rely on planting obstacles of some sort or another (such as beach grass or sand reed, or wind break nets) in and on the beach. Although such methods do retain sand on the beach they suffer from the important shortcoming that such obstacles actually form small dunes. At the beginning of the summer season these small dunes have to be flattened. This increases the costs and for some time the beach cannot be used. If this flattening is not done, the actual size of the flat beach is reduced and after some seasons the shore-line moves into the sea. Since roads and stands do not move this effect causes an increase in the distance between roads and stands and the shore line.

It is an object of the invention to provide a method and a system for stabilisation to overcome or reduce the disadvantages of the known methods and systems.

To this end the system in accordance with the invention comprises:

- an water inlet preferably to draw water from a nearby water volume
- an inlet conduit from the inlet to a pumping station
- a outlet conduit from the pumping station to
- one or more water dispensing means on or at the sandy shore
- a pumping station to pump water from the inlet conduit to the outlet conduit
- a control unit to control the action of the pump
- a means for supplying a wind signal indicative of the wind force to the control unit
- the control unit having means to, in dependence on the wind signal, control the action of the pump.

The invention is amongst others based on the insight that sand depletion is mainly caused by the action of the wind. Above a certain wind speed (roughly 4–6 Beaufort, depending somewhat on the coarseness of the sand) sand is blown away if it is dry. Wet sand is not so easily (or not at all) blown away. The pumping action and thus whether or not water is dispensed and or the amount of water dispensed through the water dispensing means is controlled by the control unit, which does so in dependence on the wind signals. This makes it possible to dispense water when needed. Preferably the inlet is to draw water from a nearby water volume because when water is used from a nearby water volume such as the nearby sea, ocean or lake, the system does not introduce any contamination on the beach that isn't already there. There are therefore no environmental problems. Preferably, the control unit has means for making or keeping the pump inactive when the wind speed as indicated by the wind signal is below a predetermined value.

This prevents dispensing water when the wind force is below a value at which no or only little sand is being transported by the wind, even if the sand is dry, thus reducing the costs of operation of the system.

Said value is preferably between 4 and 6 Beaufort. The inventors have found that the onset of sand transport through wind action lies generally in this regime.

Preferably the control means also has means for making or keeping the pump inactive when the wind signal is above a predetermined signal.

Above a predetermined signal (for instance 10 or 11 Beaufort) the pump is shut down, for protection as well as because usually above a certain wind speed so much moisture from the sea or lake is blown inland that the sand is wet, and/or water supplied is blown too far away from the shore.

Preferably the system comprises means for supplying a rain signal indicative of the rain fall to the control unit.

Preferably, the control unit has means for making or keeping the pump inactive, if it rains at the shore part where the water dispensing means are located.

This prevents dispensing of water when it is raining and reduces thereby the costs of operating the system.

Instead of or in addition to a rain meter the system can also have means for supplying a moisture signal indicative of the water content of the sand near the water dispensing means to the control unit. Such means enable 'fine-tuning' of the pomp action.

Preferably the inlet is situated at some distance form the shore line, which reduces the risk of swimmers being hurt by the inlet. The inlet can for instance situated at some distance in the sea or lake or in a well. In the latter case the water is drawn from ground water, but this is in effect also means drawing water from the nearby water volume and at some (in this case vertical) distance from the shore line. Using a well construction is preferred in those cases were the system is used for a longer period of time and/or where damage to the inlet could be a problem due to for instance regularly appearing storms or violent (under) currents or ships or damage to the undersea environment could cause problems.

Preferably the inlet comprises means to prevent sand from entering the inlet conduit and/or reduce the amount of sand entering the inlet conduit. Such means can for instance comprise a filter. Sand in the inlet conduit has a corrosive action on the inlet conduit and could reduce the pumping speed or plug up the water dispensing means.

Preferably the inlet conduit comprises plastic pipes. Such pipes are generally much more corrosion resistant than metal pipes.

Preferably the outlet conduit comprises plastic pipes for the same reason.

The water dispensing means may comprise showers at some height above the beach. Such showers may sprinkle water downwards or upwards. Alternatively the water dispensing means may comprise one or more water squirts which squirt water in a circular motion. The means for dispensing water, for instance in the form of a squirt, may be and preferably is mobile. Such a system makes it possible to use the system when needed and makes it easier to use the beach for other activities when the system is not in use. A mobile system, however, may requires supervision, if only to prevent theft, but also out of safety precaution to prevent e.g. children from climbing on the mobile water squirt, whereas a stationary system can be operated without supervision.

The system preferably also comprises a means for measuring temperature, and means for supplying a temperature signal indicative of the temperature from the means to measure temperature to the control unit. The amount of water to be dispensed for most efficient action can thereby be better controlled. This is in particular of importance for such shores where even in the off-season relatively high temperatures may be reached.

Preferably, when the shore is provided with a breakwater, the inlet is situated near the breakwater. Areas near the breakwater are off-limit for swimmers so that the risk that a swimmer comes near the inlet is strongly reduced.

Preferably a safety device is provided around the inlet. Such a safety device e.g. is used to prevent swimmers from coming near the inlet.

This reduces the risk of injuries to swimmers and it makes it possible for the inlet to remain in place during the summer season.

Preferably the safety device comprises a grid with small openings. Such grid also prevents objects larger than the grid size form entering the system, thus also protecting the system itself.

Preferably the control unit comprises an automatic mode, enabling the system to run automatically as well as an operator mode enabling the system to be run by an operator. Although in some circumstances automatic mode is preferred, in other, for instance on a bright winter day, when, despite the fact that wind action may cause sand to be transported, economic activities on the beach would be greatly jeopardised by activation of the system. 'Operator controlled' could in embodiments mean remotely controlled by some general operator overlooking several systems.

The method in accordance with the invention comprises the steps of pumping water from an inlet to draw water from a nearby water volume, preferably at some distance from the shore line, via an inlet conduit from the inlet, a pumping station and a outlet conduit from the pumping station to one or more water dispensing means on or at the sandy shore to moisten sand around and/or near the water dispensing means, supplying a wind signal indicative of the wind force to the control unit and controlling via the control means the action of the pump.

These and others aspects of the invention will hereinbelow be further disclosed and discussed with the reference to the drawings in which FIG. 1 schematically shows as system in accordance with the invention.

Figure 1:
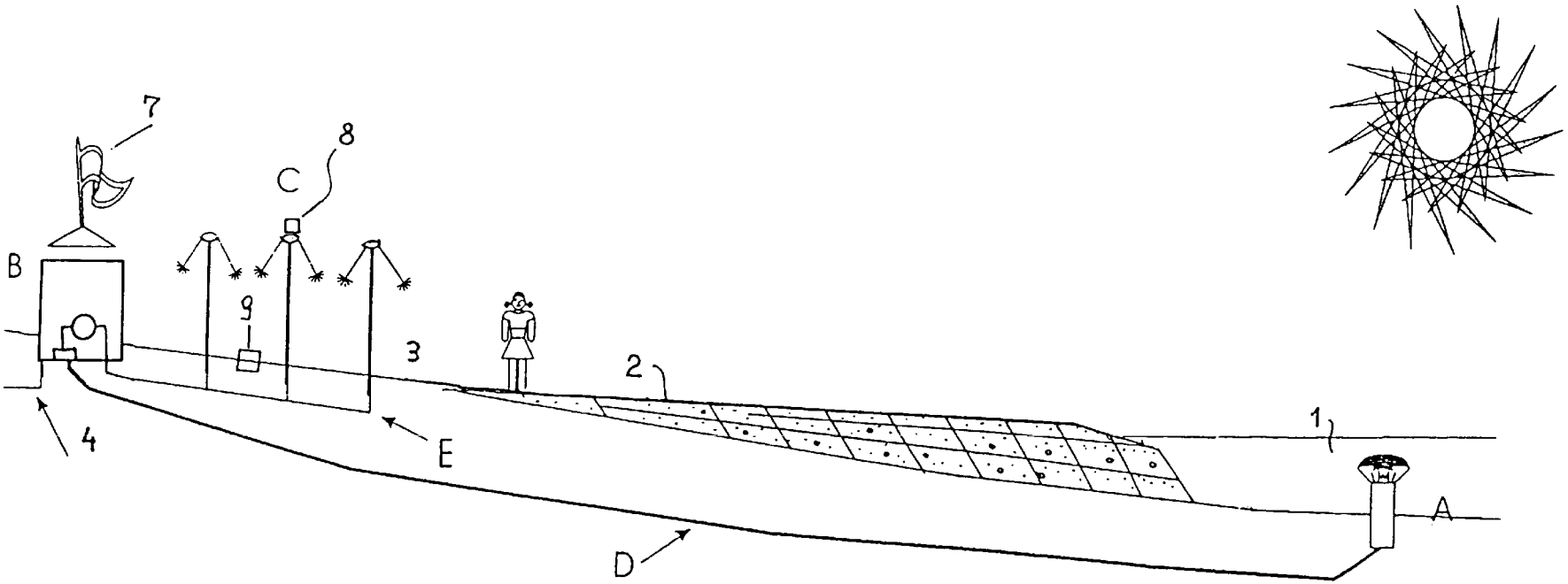
Figure 2:
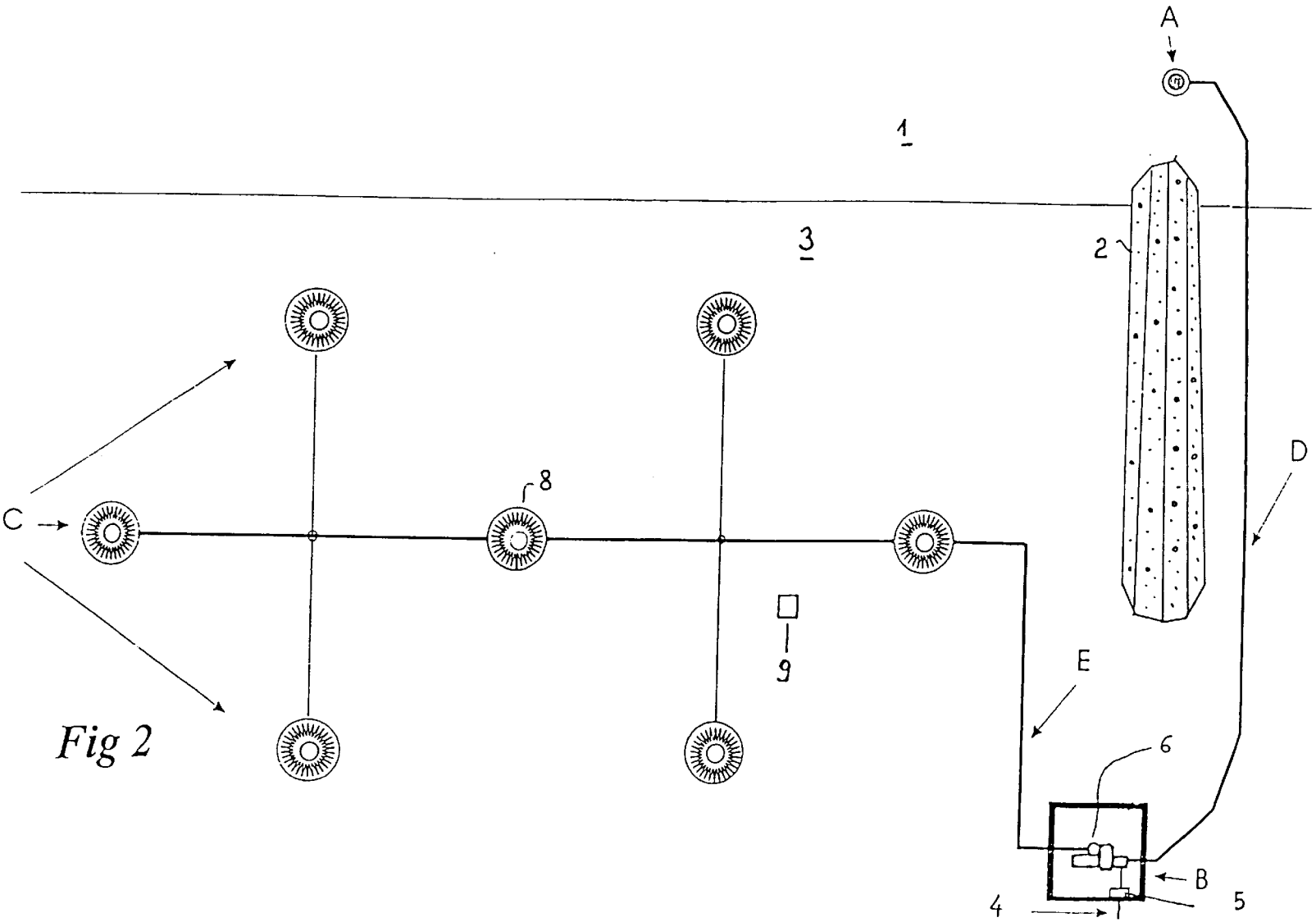
FIGS. 2 and 3 show in top view two embodiments of the system in accordance with the invention.
Figure 3:
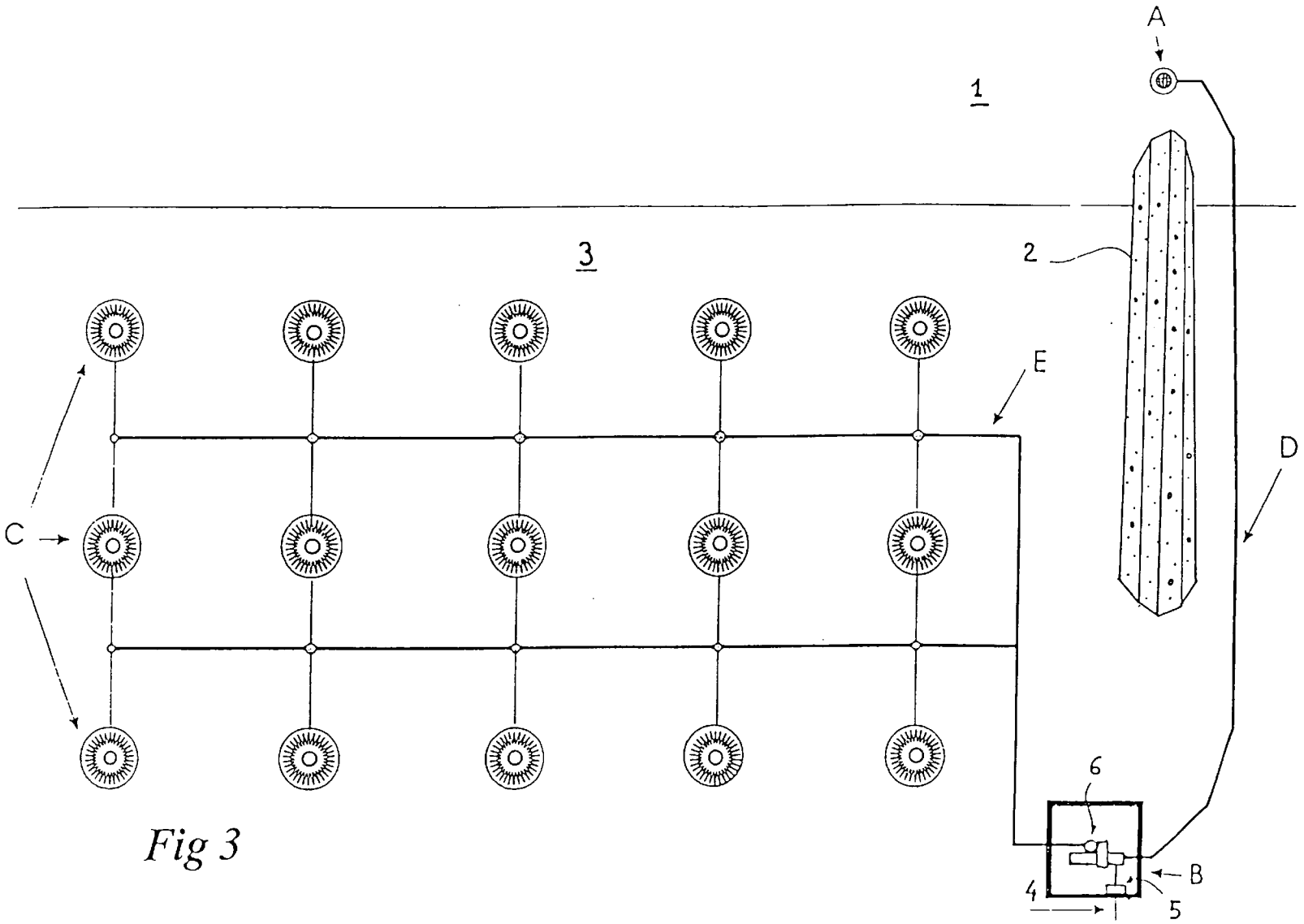

FIG. 1 shows a side view of a system in accordance with the invention. An inlet (A) is positioned in the water 2 some distance from the shoreline near a water breaker 2 extending from the shore 3. Water is pumped, via an inlet conduit D, through a pumping station B, having a pump 6, via outlet conduit E to water dispersing means C. FIGS. 2 and 3 show in top view two possible systems of water dispersing means. A wind meter 7 is provided, for instance on top of pumping station B. Pumping station B comprises in this example control unit 5, which control the action of pump 6. Energy is supplied via lead 4. A rainfall meter 8 is provided on one of the dispersing means (showers) C. On the sand a moistness meter 9 may be provided.

Figure 4:
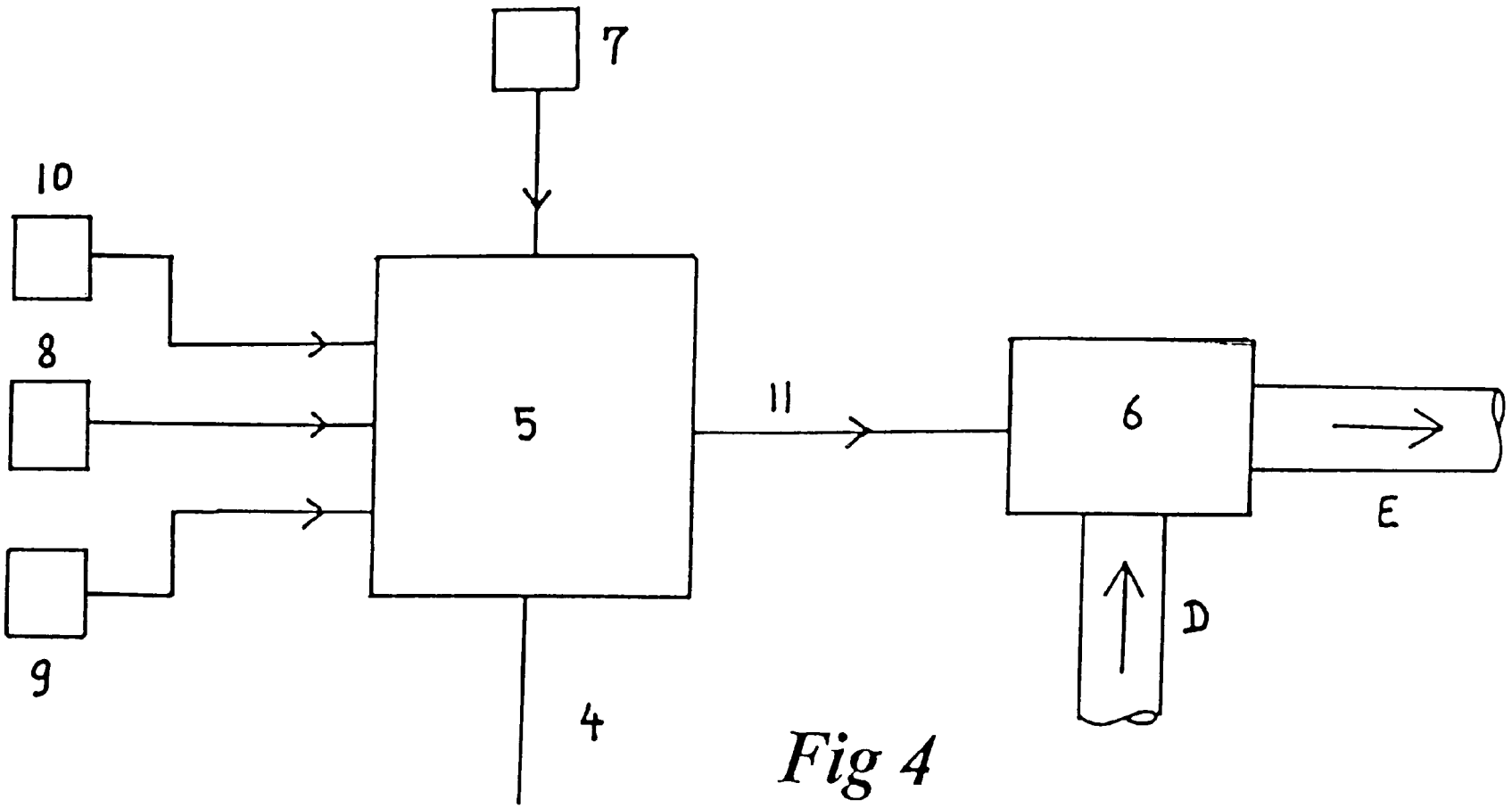
FIG. 4 shows schematically how, in different embodiments of the invention the control unit controls the action of the pump.

FIG. 4 shows schematically how, in different embodiments of the invention, the control unit controls the action of the pump.

The control unit 5 receives signals from the wind meter 7, and possibly also from the rain fall meter 8 and/or the moistness meter 9 and/or a temperature meter 10. These signals are compared to gauge signals or in another manner used to compute a control signal 11 to control the action (on-off and/or pump speed) of pump 6 to pump water from inlet conduit D into outlet conduit E. The wind meter signal 7 may be a signal comprising, apart from the wind speed also information on the wind direction. Below a certain wind speed the pump is inactive. Above a certain wind speed the pump is also inactive out of security precautions. The wind direction may also be of importance, if the wind is blowing inland the wind speed at which the pump is made active may be higher than when the wind is blowing from land into the sea. The control unit may have an internal memory keeping track of the rain fall over a period of time. Such would give an indication of the 'wetness' of the sand and thus of the need to supply water.

Figure 5:
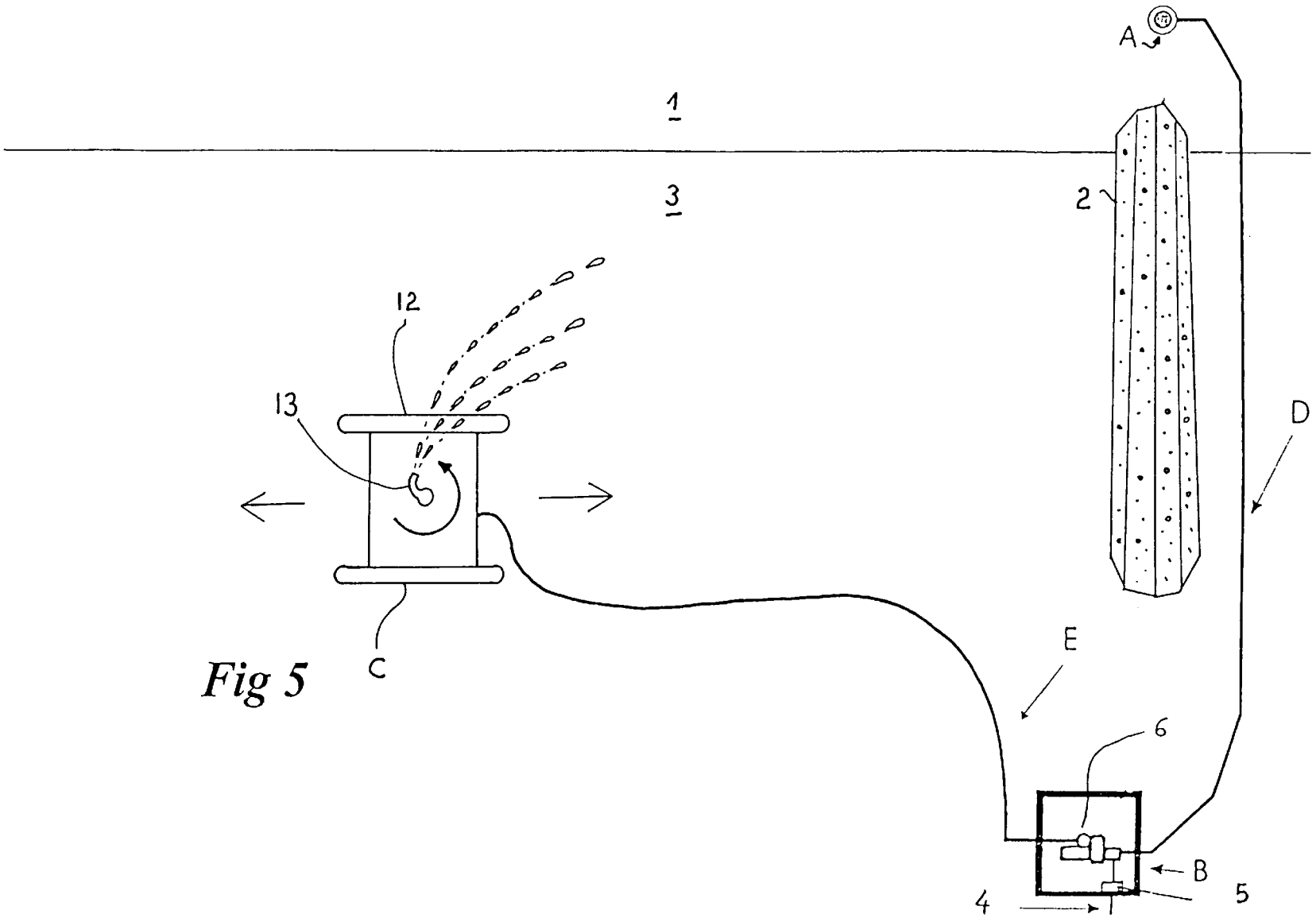
FIG. 5 illustrates a mobile water dispensing means.

FIG. 5 shows a mobile water dispensing means. It comprises a mobile vehicle 12, upon which a rotating water squirt 13 is mounted. The vehicle is able to move back and forth along the beach, while the squirt is rotating. In this manner the sand can be made wet.

Within the concept of the invention many further variations are possible for a person skilled in the art.

Figure 6:
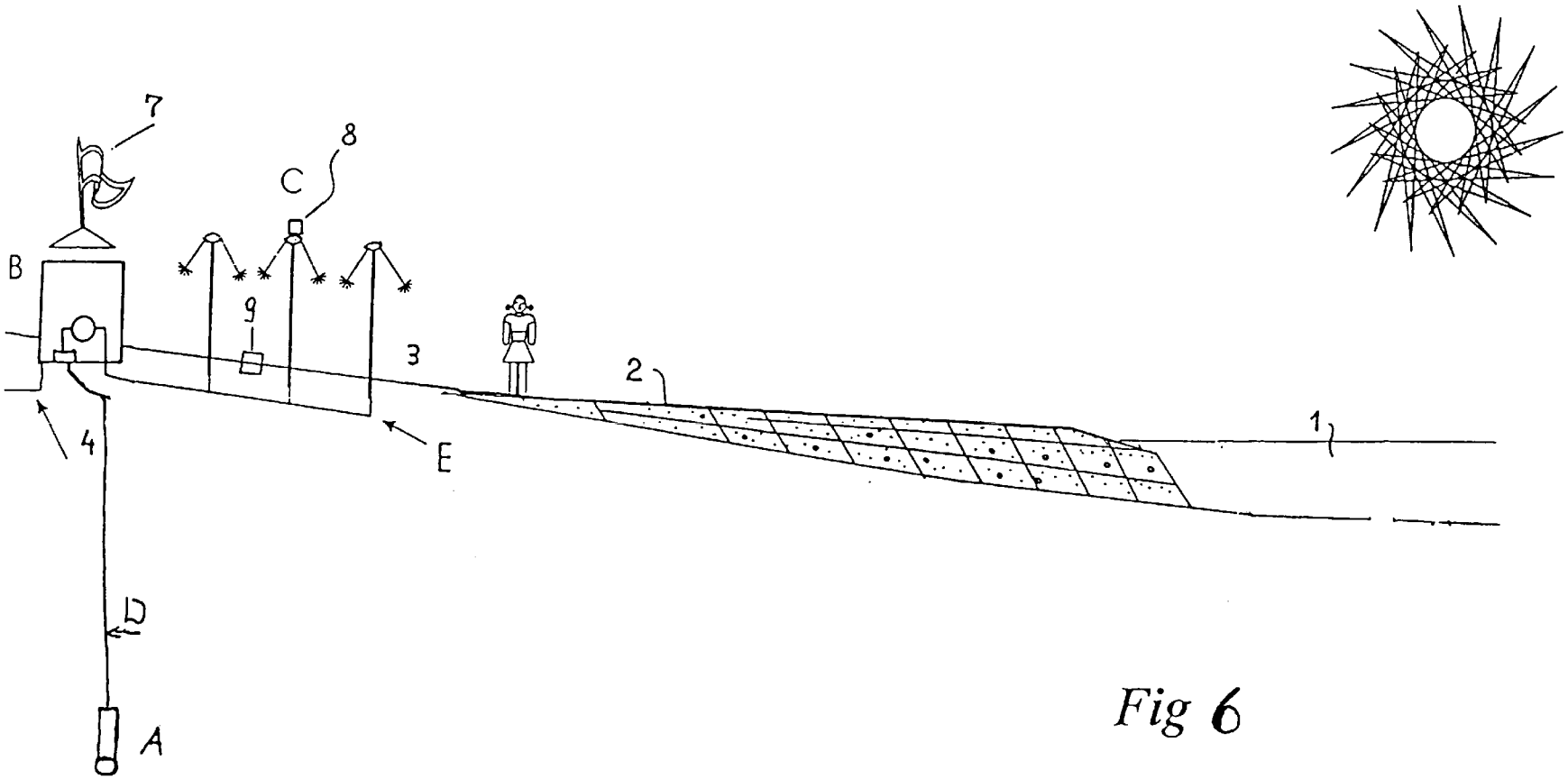
FIG. 6 illustrates an embodiment of the system.

FIG. 6 for instance shows a system in which the inlet A is provided in a well (i.e. draws ground water). The ground water, however, forms one water volume with the nearby sea or lake.

In short the invention can be described as follows:

To battle the problem of sand loss due to wind action on a sandy shore a system is used which pumps water from the nearby water volume and make the sand wet depending on wind speed and/or other conditions such as rain, moistness of the sand, wind direction and temperature.

What is claimed is:

1. A system for stabilisation of a sandy shore comprising:

an inlet (A) for water an inlet conduit (D) from the inlet to a pumping station (B)

a outlet conduit (E) from the pumping station to one or more water dispensing means (C) on or at the sandy shore a pumping means (6) for pumping water from the inlet via the inlet conduit (D) and the outlet conduit (E) to the water dispensing means (C)

a control unit (5) to control the action of the pump (6)

a means (7) for supplying a wind signal indicative of the wind force to the control unit the control unit having a means to, in dependence on the wind signal, control the action of the pump.

2. System as claimed in claim 1, characterised in that the control unit has means for making or keeping the pump inactive when the wind speed as indicated by the wind signal is below a predetermined value.

3. System as claimed in claim 1 or 2, characterised in that the control unit has means for making or keeping the pump inactive when the wind speed as indicated by the wind signal is above a predetermined value.

4. System as claimed in claim 1, characterised in that system comprises means (8) for supplying a rain signal indicative of the rain fall to the control unit and the control unit has means for making or keeping the pump inactive, if it rains at the shore part where the water dispensing means are located.

5. System as claimed in claim 1, characterised in that the system comprises means (9) for supplying a moisture signal indicative of the water content of the sand near the water dispensing means to the control unit.

6. System as claimed in claim 1, wherein the inlet comprises means to prevent sand from entering the inlet conduit or to reduce the amount of sand entering the inlet conduit or both.

7. System as claimed in claim 1, characterised in that the means for dispensing water is mobile.

8. System as claimed in claim 1, characterised in that a safety device is provided around the inlet.

9. System as claimed in claim 1, characterised in that the inlet, in operation draws water from a nearby water volume.

10. System as claimed in claim 9, characterised in that the inlet is situated at some distance of the shore line.

11. System as claimed in claim 10, characterised in that the inlet in operation draws ground water.

12. Method for stabilizing a sandy shore comprising the steps of pumping water from an inlet for water, via an inlet conduit from the inlet, a pumping station and an outlet conduit from the pumping station to one or more water dispensing means on or at the sandy shore to moisten sand around or near the water dispensing means, supplying a wind signal indicative of the wind force to a control unit and controlling via control means the action of the pump.

* * * * *